US007503130B2

(12) United States Patent
Helton et al.

(10) Patent No.: US 7,503,130 B2
(45) Date of Patent: Mar. 17, 2009

(54) WATER DRAINING SHOE

(75) Inventors: Roy Helton, Smyrna, TN (US); Colin Elliot, Nashville, TN (US)

(73) Assignee: Genesco, Inc., Nashville, TN (US)

( * ) Notice: Subject to any disclaimer, the term of this patent is extended or adjusted under 35 U.S.C. 154(b) by 798 days.

(21) Appl. No.: 10/994,547

(22) Filed: Nov. 22, 2004

(65) Prior Publication Data

US 2005/0120587 A1 Jun. 9, 2005

Related U.S. Application Data

(60) Provisional application No. 60/527,468, filed on Dec. 4, 2003.

(51) Int. Cl.
*A43B 7/06* (2006.01)
*A43B 13/12* (2006.01)

(52) U.S. Cl. ..... 36/3 B; 36/3 R; 36/30 R

(58) Field of Classification Search ..... 36/97, 36/3 R, 3 B, 25 R, 30 R, 28, 29
See application file for complete search history.

(56) References Cited

U.S. PATENT DOCUMENTS

| | | | | | |
|---|---|---|---|---|---|
| 2,003,646 | A * | 6/1935 | De Blasio | 36/3 R |
| 3,050,875 | A * | 8/1962 | Robbins | 36/3 B |
| 4,438,573 | A * | 3/1984 | McBarron | 36/3 B |
| 4,619,055 | A * | 10/1986 | Davidson | 36/28 |
| 4,912,858 | A * | 4/1990 | Mochizuki | 36/3 B |
| 5,983,524 | A * | 11/1999 | Polegato | 36/3 R |
| 6,138,385 | A * | 10/2000 | Jungkind et al. | 36/97 |
| 6,305,099 | B1 * | 10/2001 | Chu | 36/3 B |
| 6,438,872 | B1 * | 8/2002 | Chil et al. | 36/97 |
| 6,574,888 | B2 * | 6/2003 | Miller et al. | 36/97 |
| 6,675,501 | B2 * | 1/2004 | Pfander | 36/28 |
| 6,681,501 | B1 * | 1/2004 | Polifroni | 36/3 B |
| 6,807,754 | B2 * | 10/2004 | Miller et al. | 36/97 |
| 6,823,609 | B2 * | 11/2004 | Moretti | 36/30 R |
| 6,857,202 | B2 * | 2/2005 | Pfander | 36/3 R |
| 6,922,914 | B2 * | 8/2005 | Pfander | 36/28 |
| 6,976,319 | B2 * | 12/2005 | Pfander | 36/3 R |
| 6,990,754 | B2 * | 1/2006 | Bray et al. | 36/44 |
| 2001/0007176 | A1 * | 7/2001 | Attilieni | 36/3 B |
| 2002/0040537 | A1 * | 4/2002 | Polegato Moretti | 36/14 |
| 2002/0170206 | A1 * | 11/2002 | Chil et al. | 36/97 |
| 2002/0178617 | A1 * | 12/2002 | Chil et al. | 36/97 |
| 2003/0106244 | A1 * | 6/2003 | Miller et al. | 36/97 |
| 2004/0103559 | A1 * | 6/2004 | Pfander | 36/44 |
| 2004/0107604 | A1 * | 6/2004 | Ha | 36/97 |
| 2005/0241082 | A1 * | 11/2005 | Moretti | 12/142 V |
| 2006/0107553 | A1 * | 5/2006 | Clark et al. | 36/97 |

* cited by examiner

*Primary Examiner*—Marie Patterson
(74) *Attorney, Agent, or Firm*—Kilpatrick Stockton LLP

(57) ABSTRACT

The invention relates to a shoe configured to provide comfort for use in dry conditions and to facilitate water removal in wet conditions. The shoe includes two removable inserts—one specifically configured for dry conditions and one specifically configured for wet conditions. Embodiments of the shoe include an upper, an innersole, an outsole and a first removable insert. The insert may include a plurality of holes and a plurality of protrusions on its bottom surface to aid in water removal. The outsole may include a wicking textile on its upper surface and at least one drain hole for aiding in the removal of water from the shoe. The drain hole(s) slopes upwardly from the outsole toward the wicking textile.

21 Claims, 8 Drawing Sheets

WATER DRAINING SHOE

CROSS REFERENCE TO RELATED APPLICATIONS

This application claims priority to U.S. Application Ser. 60/527,468, filed on Dec. 4, 2003, which is incorporated herein by reference.

BACKGROUND OF THE INVENTION

1. Field of the Invention

The invention generally relates to shoes, and more particularly to a shoe configured to provide comfort for use in dry conditions and to facilitate water removal from the shoe when used in wet conditions.

2. General Background of the Invention

Wet shoes are a nuisance and a health hazard. Depending on the temperature, wet shoes can lead to frostbite or fungus. Bacteria grows in warm, moist environments and thus, can lead to foot infections. People may be more likely to slip and fall when wearing wet shoes. Additionally, wet shoes may be very uncomfortable. Keeping water out of shoes while on a boat is particularly difficult, but the problem may arise virtually anywhere, such as when it rains, for example.

People frequently step into water or have water splashed over their feet, causing the shoes to fill with water. One solution to this problem involves waterproofing the shoe to prevent water from entering the shoe. This solution is often unsuccessful for a variety of reasons. First, water often enters the shoe from the top, and waterproofing cannot prevent water from entering where the foot enters the shoe. Second, the waterproof construction may cause the shoe to retain water once it has entered the shoe, particularly if the shoes are made of a durable non-porous material.

As mentioned above, wet shoes are a problem on boats due to the proximity to water and the frequent cleaning required for boats. Shoes specifically designed for wearing on boats are known. Such shoes generally provide good traction for walking on wet surfaces. A problem with boat shoes, however, is that boating often requires the wearer of a boating shoe to be on his feet for a large amount of time. Traditionally, boating shoes have been lacking in the support found in other athletic shoes.

BRIEF SUMMARY OF THE INVENTION

Embodiments of the invention provide a shoe, configured to provide comfort for use in dry conditions and to facilitate water removal in wet conditions. The shoe includes two removable inserts—one specifically configured for dry conditions and one specifically configured for wet conditions.

Embodiments of the shoe include an upper, an innersole, an outsole and a first removable insert. The innersole may be located between a wearer's foot and the outsole. The insert may include a plurality of holes and a plurality of protrusions on its bottom surface to aid in water removal. The outsole may include a wicking textile on its upper surface and at least one drain hole for aiding in the removal of water from the shoe. The at least one drain hole slopes upwardly from an outer surface of the outsole toward the wicking textile.

In some embodiments, the shoe includes a second removable insert that is cushioned to provided comfort when the shoe is used in dry conditions.

Other embodiments of the invention include a kit for keeping feet covered and dry. The kit includes a shoe including an upper, an innersole and an outsole. The outsole may include a wicking textile and at least one drain hole for aiding in the removal of water from the shoe. The at least one drain hole slopes upwardly from an outer surface of the outsole toward the wicking textile. The kit also includes a first removable insert including a plurality of holes and a plurality of protrusions on a bottom surface of the insert to aid in water removal from the shoe. The kit also includes a second removable insert including cushioning to provide comfort when the shoe is used in dry conditions.

Further details and embodiments of the invention are set forth below. These and other features, aspects and advantages of the invention are better understood when the following Detailed Description is read with reference to the accompanying drawings.

DETAILED DESCRIPTION OF THE INVENTION

The invention generally relates to shoes configured to facilitate water removal from the interior of the shoe in wet conditions. The shoe includes an innersole with a plurality of holes in the toe area. The holes may be located above a wicking textile recessed into the upper surface of an outsole. The wicking textile may be connected to drain holes in the outsole designed to allow water to exit the shoe easily. The innersole may also include a plurality of boles in the heel area. These holes may be connected to additional drain holes in the heel area of the outsole. Inserts configured to provide comfort to the wearer in wet or dry conditions may be inserted in the shoe. An insert configured for dry conditions may be cushioned and include a plurality of holes on its upper surface. An insert configured for wet conditions may include a plurality of holes on its upper surface.

This invention will now be described more fully with reference to the drawings, showing preferred embodiments of the invention. However, this invention can be embodied in many different forms and should not be construed as limited to the embodiments set forth. Although a "boat shoe" commonly used in boating is illustrated in the figures, the invention includes any type of shoe with the features described below. For example, athletic shoes, hiking boots, dress shoes and casual shoes are all within the scope of the invention.

A shoe is generally composed of different parts. The upper is the leather or synthetic part of the shoe that encases the foot. Uppers come in many styles depending on the type of shoe. The sole consists of an innersole (or insole) and an outsole. The innersole is inside the shoe where the foot rests; the outsole is the bottom of the shoe that contacts the ground and helps determine traction. An insert can be used and can be a piece of material inside a shoe to cover the sole or innersole. The insert can be decorative or functional.

Figure 1:
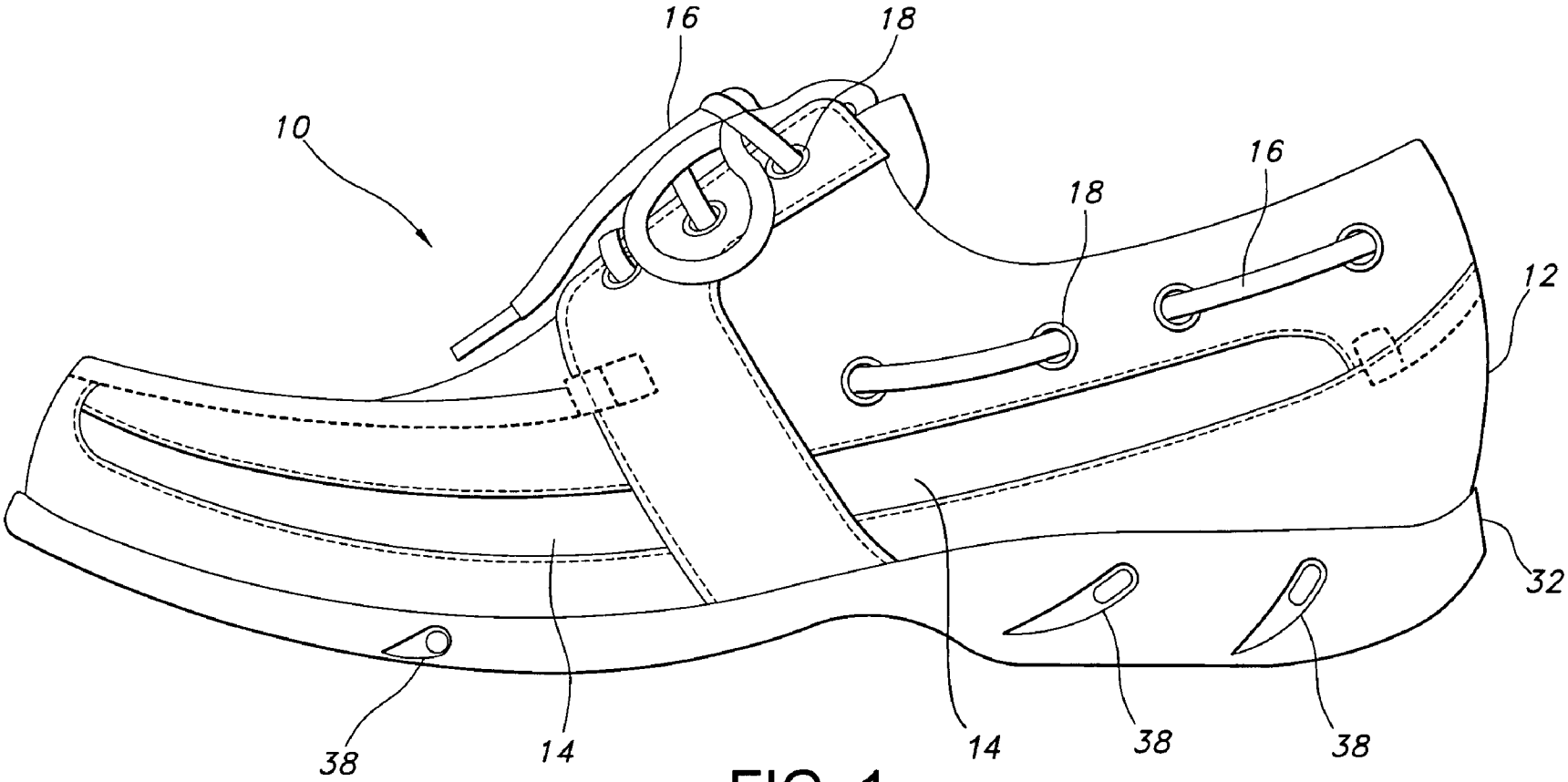
FIG. 1 is a side elevation view of a boat shoe according to an embodiment of the invention.

As shown in FIG. 1, the shoe 10 of one embodiment of the invention includes an upper 12. In some embodiments, the upper 12 is constructed of leather, preferably veal, nubuck or a combination thereof. In a preferred embodiment, the leather has been treated so that it is substantially waterproof. The upper 12 may include a mesh insert 14, which increases airflow in the shoe 10 and facilitates moisture removal.

The upper 12 can include laces 16 that may be used to adjust the shoe to the foot. The laces 16 may be made from cotton, elastic, leather, mercerized cotton, rayon, silk, etc. The upper 12 also can include eyelets 18, which are rings of metal or other material inserted in the shoe upper 12 to provide a durable ring for lace holes. In certain embodiments, the laces 16 are round, however, the laces 16 may be of any shape that will fit through the eyelets 18, such as flat or oval. In certain embodiments, the eyelets 18 are rustproof.

Figure 2:
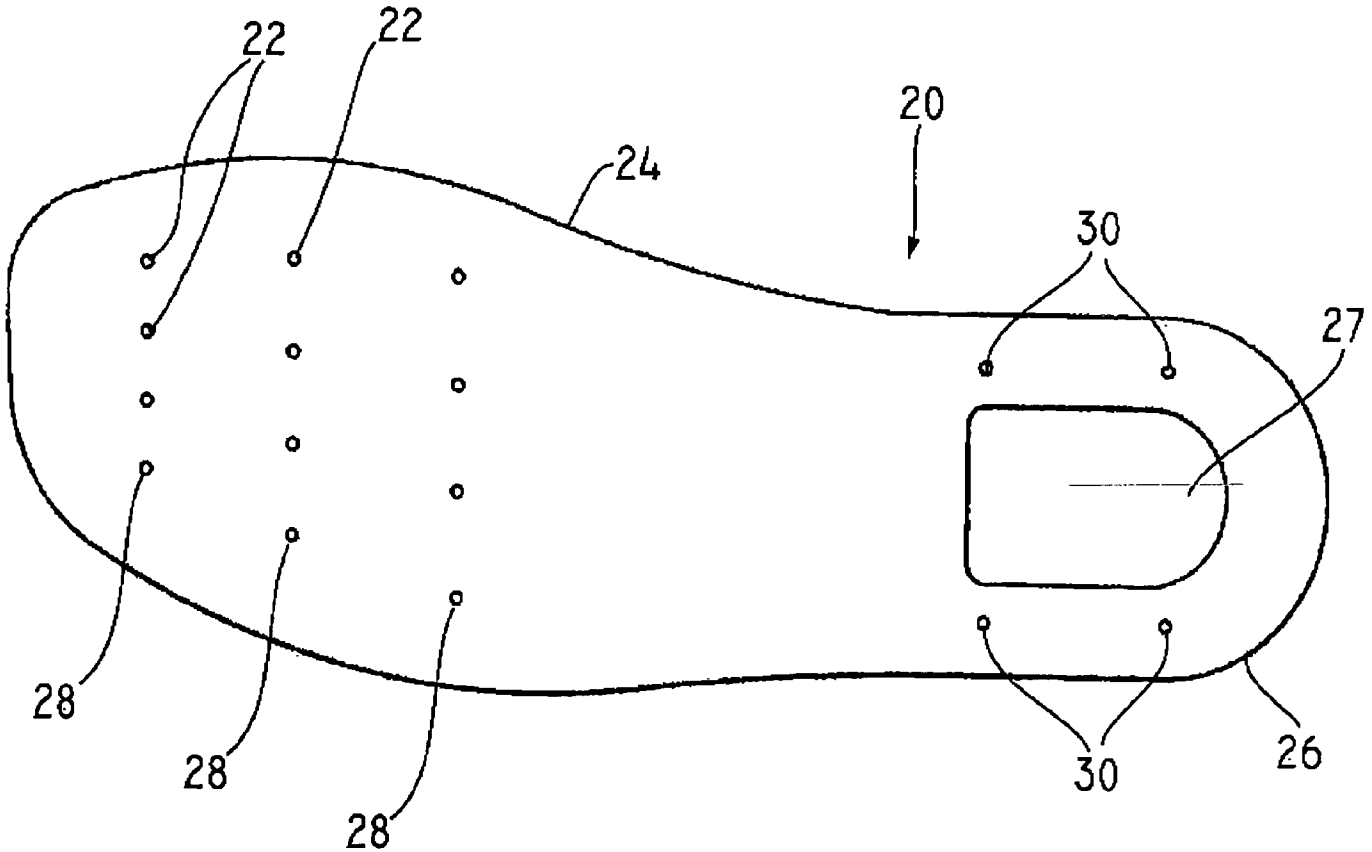
FIG. 2 is a top plan view of an innersole of a shoe according to an embodiment of the invention.

The shoe 10 may further include an innersole. As stated above, innersoles are generally located on the inside of a shoe; also, between the wearer's foot and the outsole. FIG, 2 illustrates one embodiment of an innersole 20. When the shoe 10 is assembled, the edges of the innersole 20 may be stitched to the upper 12 (not shown). The innersole 20 is generally located directly above the outsole 32. The innersole 20 may be constructed from leather, composition, fiberboard, felt or cork. In one embodiment, the innersole 20 is constructed from polyethylene. The innersole 20 includes a plurality of holes 22 in the forward area 24, where the ball of the foot would be located, and heel areas 26. In certain embodiments of the shoe 10, the forward area 24 includes three rows 28 of holes 22, each row 28 having approximately four holes 22. In yet other embodiments, the heel area 26 includes two pairs 30 of holes 22 on the periphery of the innersole 20. The innersole 20 may optionally include a void 27, such as shown in FIG. 2. The void 27 is useful if an insert with a heel plug, discussed below, is incorporated into the shoe.

Figure 3:
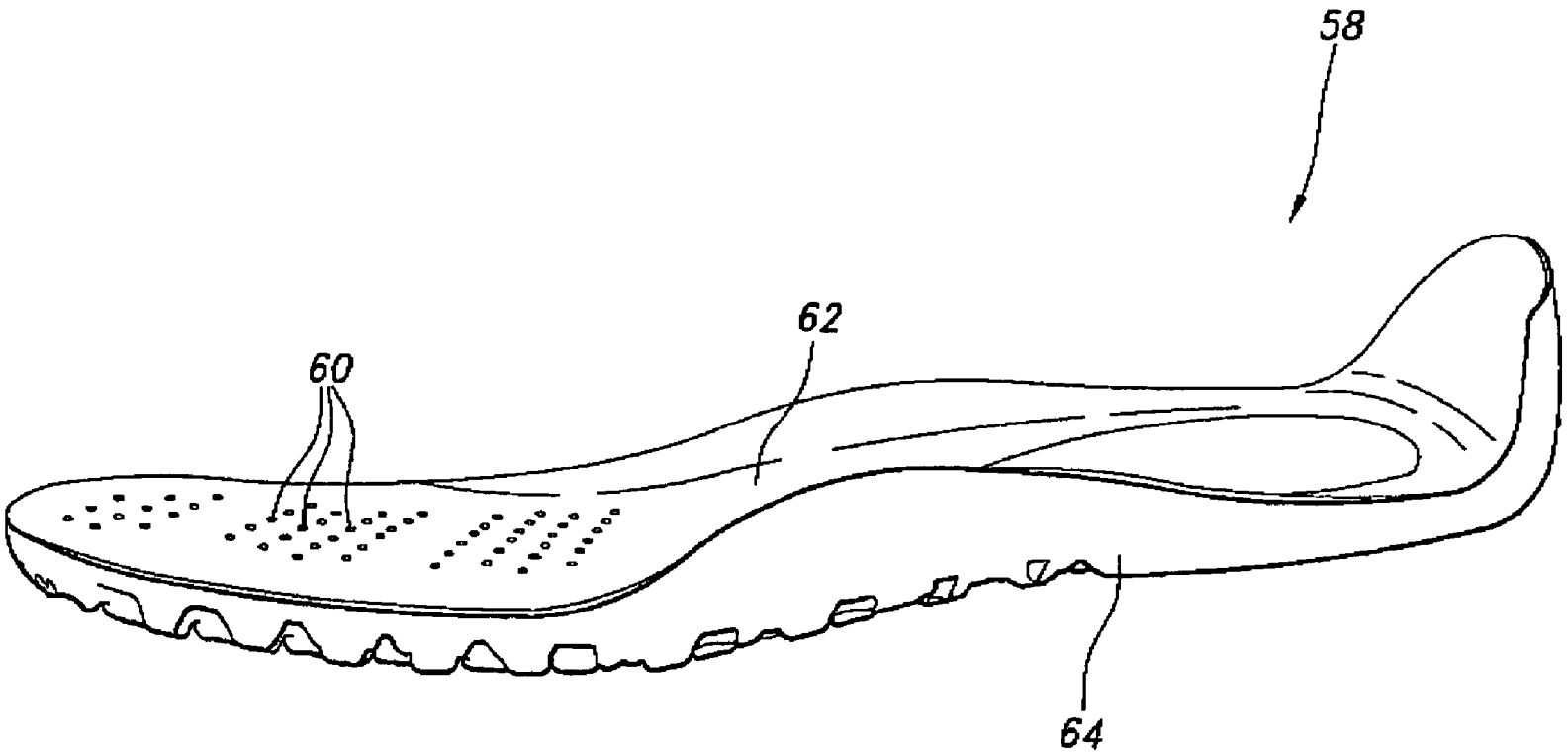
FIG. 3 is a perspective view of a wet conditions insert according to an embodiment of the invention.
Figure 4:
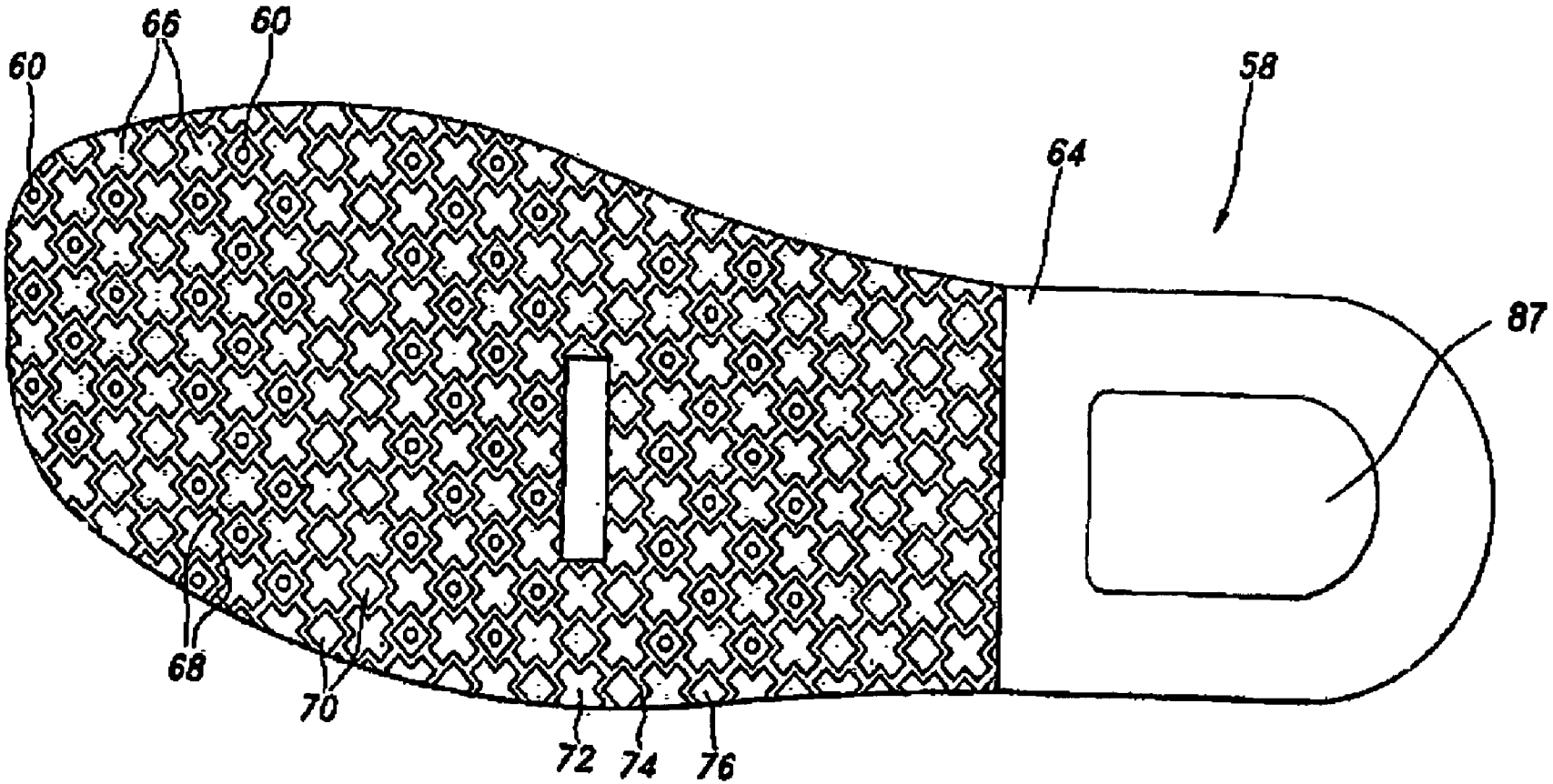
FIG. 4 is a bottom plan view of the wet conditions insert of FIG. 3 according to an embodiment of the invention.

Embodiments of the shoe 10 may include removable inserts for comfort. The removable inserts can be inserted into the shoe between the wearer's foot and the innersole or the outsole. As shown in FIGS. 3 and 4, the shoe 10 may include a removable insert 58 that is specifically configured for use when wearing the shoe 10 in wet conditions, such as when one is on a boat. This insert 58 (the "sea insert") is placed in the shoe 10 over the innersole 20. The sea insert 58 includes a plurality of holes 60 to allow water to exit from the upper surface 62 of the insert 58. The bottom surface 64 of the sea insert 58 includes a multitude of cross-shaped protrusions 66, as shown in FIG. 4. The cross-shaped protrusions 66 elevate the bottom surface 64 of the insert 58 above the innersole 20. When water enters the shoe, it flows through holes 60 in insert 58 toward the bottom surface 64 of the insert 58. The water flows through spaces 68 between the cross-shaped protrusions 66 and through holes 22 in innersole 20. Although the sea insert 58 is designed to facilitate water removal in conjunction with the shoe 10 of the invention, the sea insert 58 can aid in water removal of virtually any shoe including openings in its upper innersole, midsole, or outsole that connect with the exterior of the shoe.

To create an even larger space for water to move through the insert 58, the bottom surface 64 of the sea insert 58 may also include a plurality of recessed areas 70 between the cross-shaped protrusions 66. Thus, in some embodiments, the bottom surface 64 of the sea insert 58 includes three planes: a middle plane 74, the plane of the protrusions 72, which extends outwardly from the middle plane 74, and the plane of the recessed areas 76, which is recessed inwardly from the middle plane 74.

The plurality of holes 60 in the sea insert are located between the protrusions 66 and preferably are located in the recessed areas 70. In the embodiment shown, the recessed 70 areas are substantially square shaped, however, the recessed areas 70 may be any shape such as oval, circular, rectangular, etc. Likewise, the protrusions 66 need not be cross-shaped and may be of any shape to coordinate with the recessed areas 70 to create the space needed for water to move through and away from the insert 58.

The sea insert 58 may be constructed of any material that will not retain water and will provide comfort to the foot. Preferably, the sea insert 58 is made from ethylene vinyl acetate (EVA) and is covered with Drilex™ on its upper surface 62.

Figure 5:
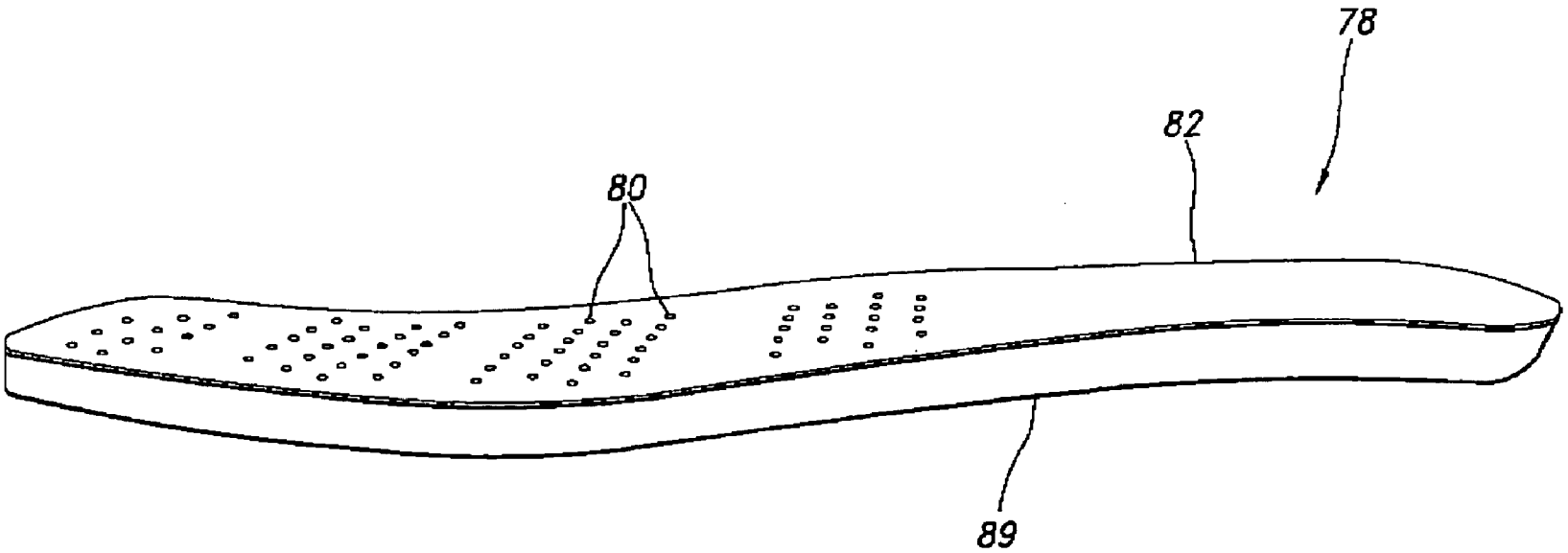
FIG. 5 is a perspective view of a dry conditions insert according to an embodiment of the invention.
Figure 6:
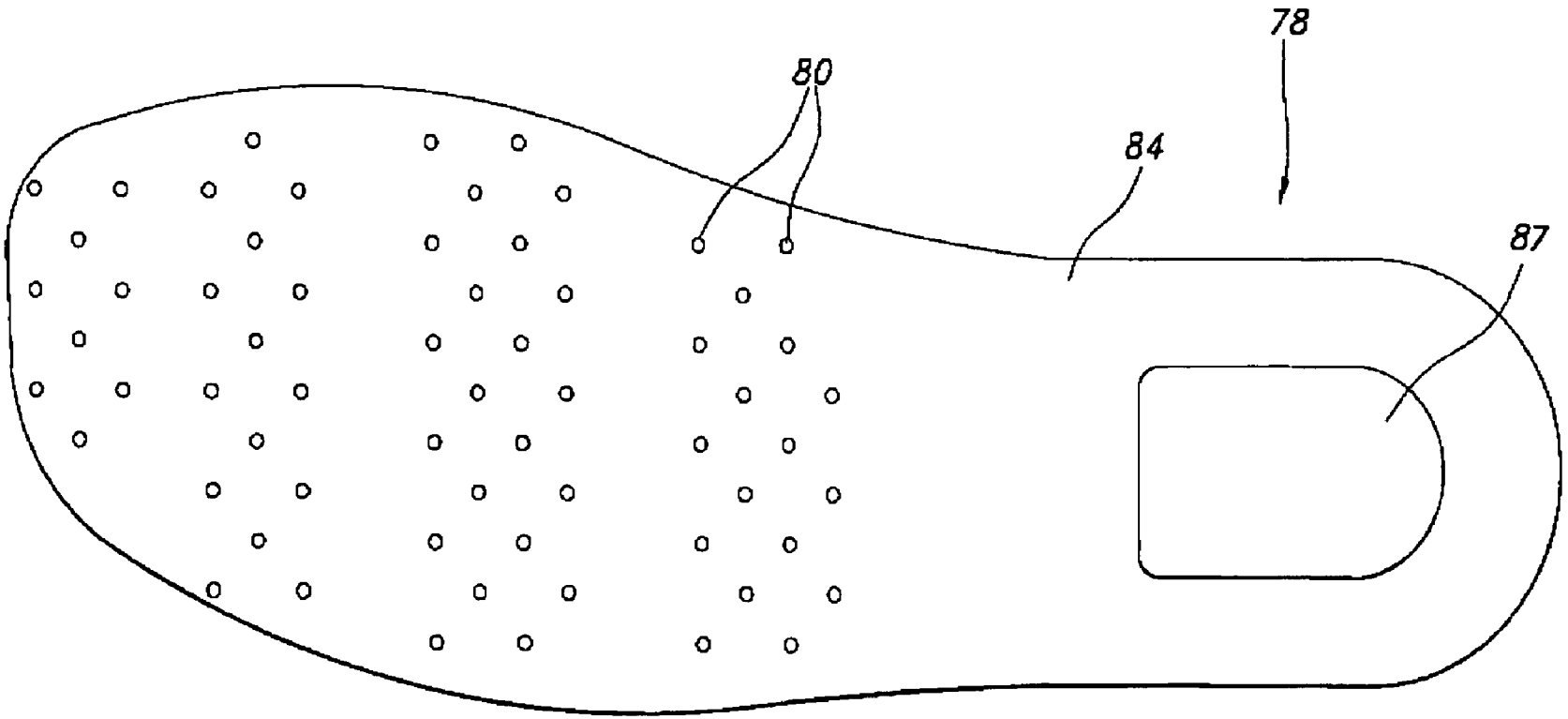
FIG. 6 is a bottom plan view of the dry conditions insert of FIG. 5 according to an embodiment of the invention.

Turning to FIGS. 5 and 6, the shoe 10 may include a removable insert 78 specifically configured for use when wearing the shoe 10 in normal (i.e., not wet) conditions. This insert 78 (the "land insert") is placed in the shoe 10 over the innersole 20. The land insert 78 may include a plurality of holes 80 to aid in ventilation. The land insert 78 may be constructed of any material that will provide comfort during normal shoe use. The land insert 78 also may include cushioning. Preferably, the land insert 78 is made from polyurethane and is covered with leather on its upper surface 82. The land insert 78 may be of any shape to fit within a shoe, including shoes other than the subject of the invention. The land insert 78 can be used with conventional shoes to increase the comfort and ventilation of the shoe.

Either of the inserts 58, 78 may include a heel plug 86 (shown in FIG. 8) for additional comfort. The heel plug 86 may be designed to release energy so that less impact is absorbed by the foot and leg. One portion of the heel plug 86 can be D-shaped with a top surface and a bottom surface (not shown). The heel plug 86 is designed to fit inside the D-shaped voids 27,48 in the heel areas 26, 46 of the innersole 20 and the outsole 32, respectively. The D-shaped voids 27, 48 in the heel areas 26, 46 are slightly larger in perimeter than the D-shaped portion of the heel plug 86.

Figure 8:
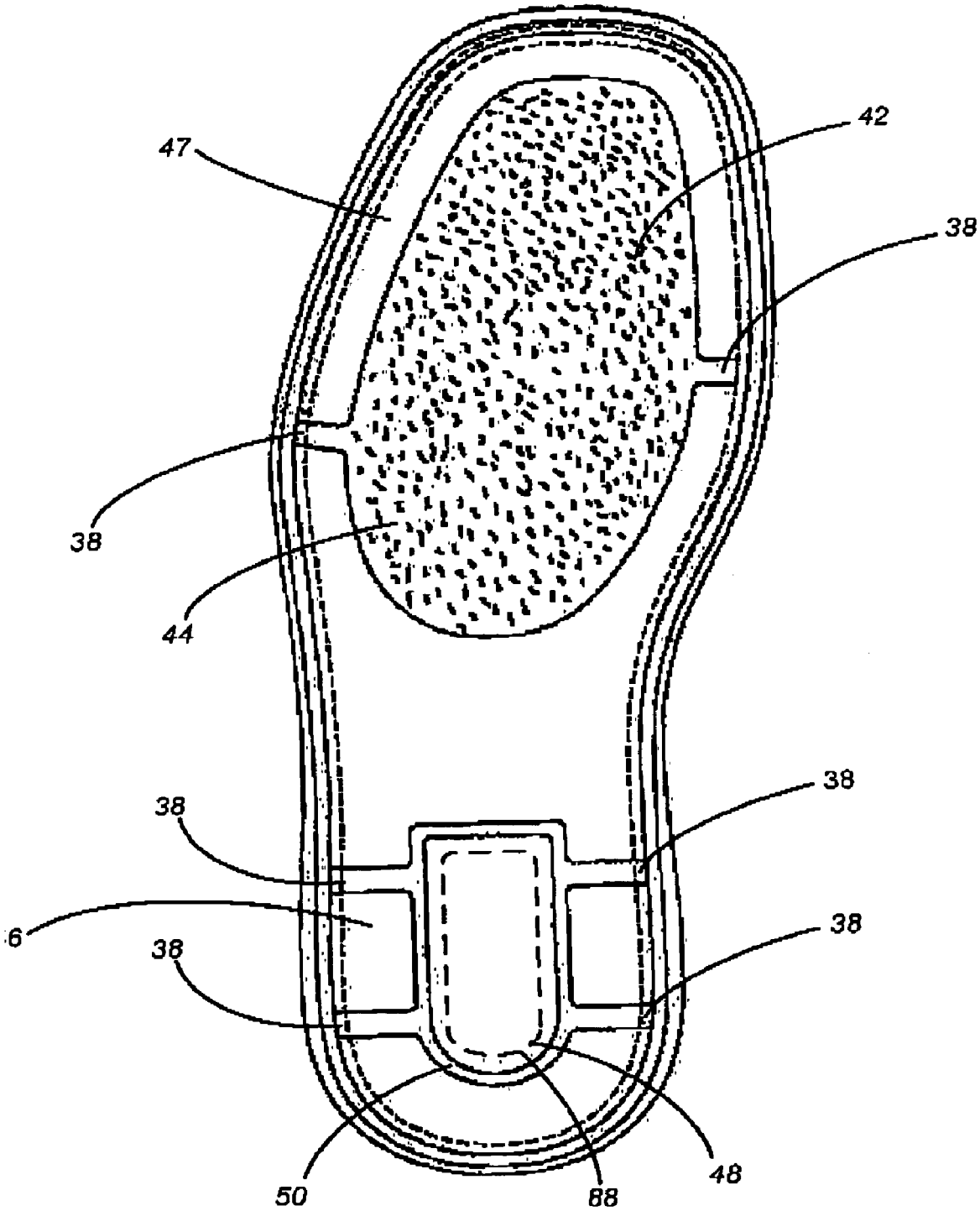
FIG. 8 is a top plan view of an outsole of a shoe according to an embodiment of the invention.

In certain embodiments (not shown), the heel plug 86 may be integrally formed with the bottom surface 84 of either the sea insert 58 or the land insert 78. As an example, the following explains how the heel plug 86 may be integrally formed with the land insert 78, as shown in FIG. 5. However, it is understood that the heel plug 86 may be similarly integrally formed with the sea insert 58, as shown in FIG. 3. The heel plug 86 is constructed of the same material as the land insert 78 in the same mold as the bottom surface 84 of the land insert 78. In other embodiments, the heel plug 86 may be separately constructed of a soft gel compound. As shown in FIG. 8, the top surface 88 of the heel plug 86 is covered by a thin, flat, top layer, the perimeter of which is larger than that of the D-shaped portion of the heel plug 86 so that the top layer extends beyond the D-shaped portion of the heel plug 86 on all sides of the top surface 88. The heel plug 86 fits underneath the insert into a D-shaped void 27 in the heel area 26 of the innersole 20 and into a D-shaped void 48 in the heel area 46 of the outsole 32. The inserts 58, 78 may include a recessed area 87, as shown in FIGS. 4 and 6, to accommodate the top layer of the heel plug 86. In other embodiments (not shown), the heel plug 86 is attached to the insert before it fits into the D-shaped voids 27, 48 in the heel areas 26, 46 of the shoe 10. The heel plug 86 is first inserted through a D-shaped void in the bottom surface of the insert. The insert lining is then applied to the top surface of the insert over the top layer of the heel plug 86. In yet other embodiments (not shown), the heel plug 86 may include several small substantially circular voids that extend vertically through the D-shaped portion of the heel plug 86.

Figure 9:
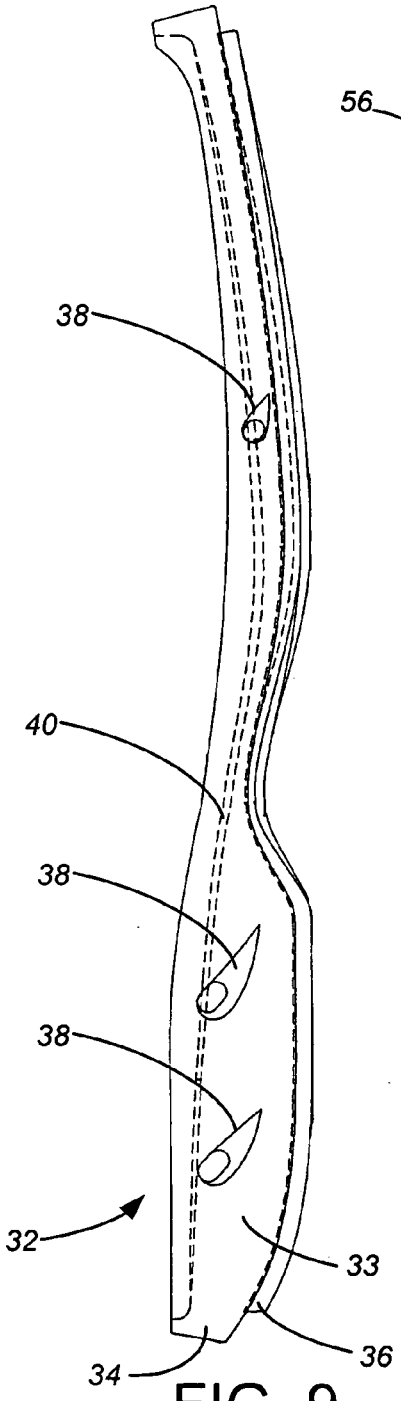
FIG. 9 is a side elevation view of the outsole of FIG. 8 according to an embodiment of the invention.
Figure 7:
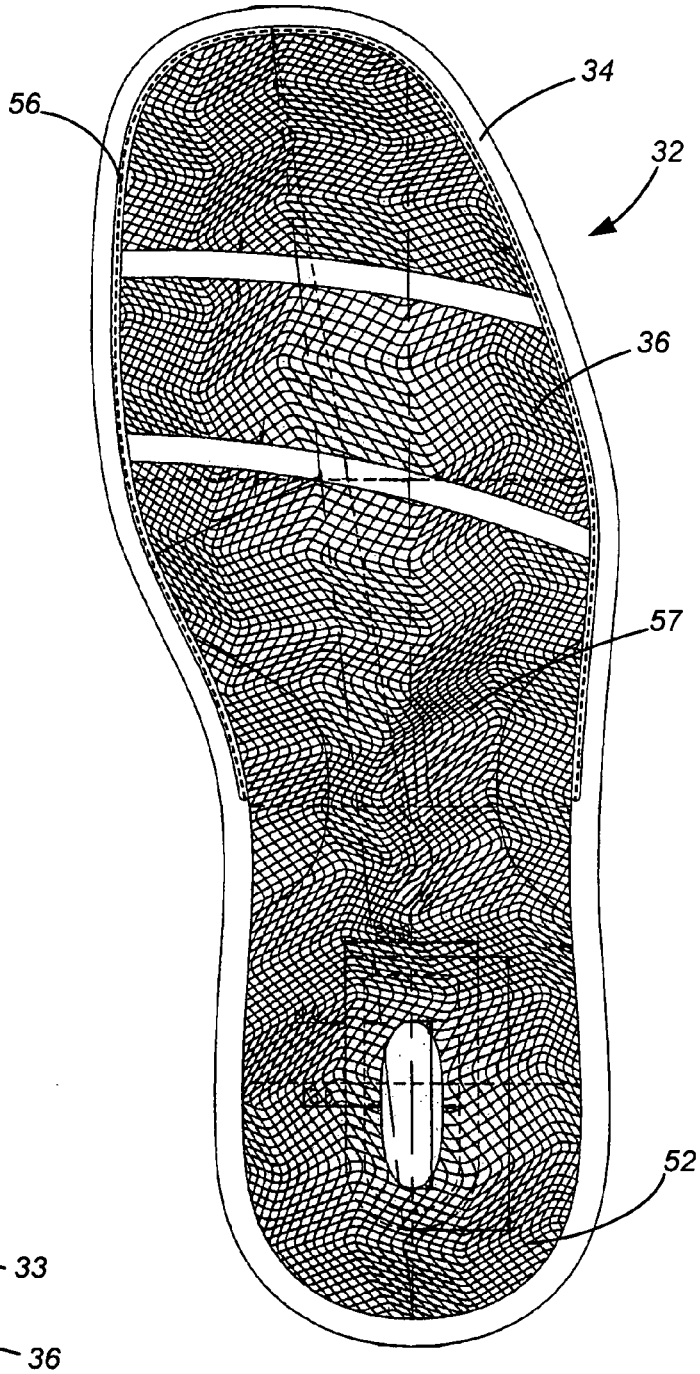
FIG. 7 is a bottom plan view of a shoe according to an embodiment of the invention.

As shown in FIGS. 7 and 9, embodiments of the shoe 10 of the invention may include a two-part outsole 32. The upper portion 34 of the outsole 32 provides stability and support for the foot. The upper portion 34 of the outsole 32 includes a plurality of drain holes 38 designed to allow water that makes its way inside the shoe 10 to exit. The drain holes 38 slope upwardly from the outer surface 33 of the outsole 32 toward the innersole so that water is encouraged to exit from inside the shoe 10 and is discouraged from entering the shoe 10.

As shown in FIG. 9, the top surface 40 of the upper portion 34 of the outsole 32 includes a recessed wicking textile 42 in the forward area 24 of the shoe 10. The wicking textile may be formed from polyurethane ester and active carbon. It can be applied to the upper portion of the outsole by spot cementing with a waterproof rubber-based cement. In certain embodiments, the recessed area 44 where the wicking textile 42 is located is approximately 5⁄32 of an inch deep and takes up almost the entire forward area 47 of the outsole 32. Drain holes 38 may be located on the periphery of the recessed area 44 leading to the exterior of the shoe 10. In certain embodiments, at least two drain holes 38 are located in the forward area 47 on the periphery of the wicking textile 42, one on either side of the textile 42.

To maximize water draining from the shoe 10, the holes 22 in the forward area 24 of the innersole 20 can be located over the recessed wicking textile 42 so that water in the shoe 10 can flow through the holes 22 in the innersole 20 and into the recessed wicking textile 42. The wicking nature of the textile 42 further facilitates the removal of water from the interior of the shoe 10. The wicking textile 42 may be any fabric that has wicking properties, such as polyurethane ester. In one embodiment, the wicking textile 42 is a combination of polyurethane ester and active carbon. Use of a wicking textile 42 is particularly advantageous compared with known boating shoes, which often incorporate channels in the upper portion of the midsole. These channels are generally small in width. Support is provided to the foot, but the channels may collapse from the weight and pressure of the wearer's foot. The wicking textile 42 of the invention provides support and drains water more efficiently because it is less likely to completely collapse.

Additional drain holes 38 may be located in the heel area 46 of the upper portion 34 of the outsole 32. The heel area 46 may include a D-shaped void 48 extending downwardly into the heel area 46 of the outsole 32. The D-shaped void 48 in the heel area 46 is configured to mate with heel plug 86, as explained above. To facilitate water removal, a water diverting area 50 may surround or partially surround the D-shaped void 48 and lead to drain holes 38. The heel area 46 preferably includes at least one drain hole 38 on either side of the D-shaped void 48. In certain embodiments, the heel area 46 includes two drain holes 38 on either side of the D-shaped void 48.

Referring again to FIGS. 7-9, the upper portion 34 of the outsole 32 may be constructed of conventional materials, such as foams (e.g., EVA), rubber compounds, such as TPU and TPR, or polymers. In certain embodiments, the upper portion 34 of the outsole 32 is constructed of polyurethane.

The lower portion 36 of the outsole 32, shown in FIGS. 7 and 9, provides needed traction and takes the brunt of the wear of the shoe 10. The lower portion 36 of the outsole 32 may be constructed of conventional materials, for example, leather, rubber, PVC, polyurethane or EVA. In certain embodiments, the lower portion is constructed of sticky rubber. The lower portion may include a pattern or texture on the bottom surface 52 to provide added traction.

The shoe 10 may be constructed according to conventional methods. However, in a preferred embodiment, the shoe 10 uses Strobel stitching (not shown) to attach the upper 12 to the innersole and Littleway stitching 56 (shown in FIG. 7) to attach the upper 12 to the outsole 32.

The foregoing description is provided for describing various embodiments and structures relating to the invention. Various modifications, additions and deletions may be made to these embodiments and/or structures without departing from the scope and spirit of the invention.

What is claimed is:

1. A shoe comprising:

an upper defining an opening for a wearer's foot;

a first removable insert exposed to the opening, comprising a plurality of holes and a plurality of protrusions on a bottom surface of the insert to aid in removal of water from the shoe;

an innersole located between the first removable insert and an outsole; and the outsole comprising a wicking textile on its upper surface and at least one drain hole, the at least one drain hole sloping upwardly from an outer surface of the outsole toward the wicking textile, wherein the wicking textile and the at least one drain hole aid in the removal of water from the shoe.

2. The shoe of claim 1, wherein the upper is constructed of water repellent leather.

3. The shoe of claim 1, wherein the upper further comprises a mesh insert to increase air flow to an interior of the shoe.

4. The shoe of claim 1, wherein the innersole comprises a plurality of holes for aiding in the removal of water from the shoe, at least one of the plurality of holes being located over the wicking textile.

5. The shoe of claim 4, wherein the innersole comprises a plurality of holes for aiding in the removal of water from the shoe, at least one of the plurality of holes being connected to at least one drain hole.

6. The shoe of claim 1, wherein the outsole comprises an upper portion and a lower portion and wherein the at least one drain hole is located on the upper portion.

7. The shoe of claim 6, wherein the wicking textile is located on the upper portion of the outsole.

8. The shoe of claim 1, wherein the wicking textile is recessed into the outsole.

9. The shoe of claim 1, wherein the wicking textile comprises polyurethane ester.

10. The shoe of claim 1, further comprising a void in a heel area of the outsole.

11. The shoe of claim 10, further comprising a water diverting area at least partially surrounding the void in the heel area and leading to at least one drain hole.

12. The shoe of claim 6, wherein the lower portion of the outsole comprises a texture on a surface coming into contact with the ground to provide traction.

13. The shoe of claim 1, further comprising a second removable insert that is cushioned to provided comfort when the shoe is used in dry conditions.

14. The shoe of claim 1, wherein the protrusions are cross-shaped.

15. The shoe of claim 14, further comprising recessed areas between the protrusions.

16. The shoe of claim 15, wherein each of the plurality of holes is located in a recessed area.

17. The shoe of claim 1, wherein the first removable insert comprises ethylene vinyl acetate.

18. The shoe of claim 10, wherein an insert comprising material softer than the outsole fits within the void in the outsole.

19. A shoe comprising:

an upper constructed of water repellent leather and comprising a mesh insert;

an innersole located between a wearer's foot and an outsole, the innersole comprising a plurality of holes for aiding in the removal of water from the shoe;

an outsole comprising a wicking textile on its upper surface and at least one drain hole for aiding in the removal of water from the shoe, the at least one drain hole sloping upwardly from an outer surface of the outsole toward the wicking textile;

a first removable insert comprising a plurality of holes and a plurality of cross-shaped protrusions on a bottom surface of the insert to aid in water removal; and a second removable insert that is cushioned to provide comfort when the shoe is used in dry conditions;

wherein at least one of the plurality of holes in the innersole is located over the wicking textile and at least one of the plurality of holes is connected to at least one drain hole.

20. A kit for keeping feet covered and dry comprising:

a shoe comprising an upper, an innersole and an outsole, the outsole comprising a wicking textile and at least one drain hole for aiding in the removal of water from the shoe, the at least one drain hole sloping upwardly from an outer surface of the outsole toward the wicking textile;

a first removable insert comprising a plurality of holes and a plurality of protrusions on a bottom surface of the insert to aid in water removal from the shoe; and a second removable insert comprising cushioning to provide comfort when the shoe is used in dry conditions.

21. A shoe comprising:

an upper defining an opening for a wearer's foot, wherein the upper is constructed of water repellent leather and comprising a mesh insert;

a first removable insert comprising a plurality of holes and a plurality of cross-shaped protrusions on a bottom surface of the insert to aid in removal of water from the shoe;

a second removable insert that is cushioned to provide comfort when the shoe is used in dry conditions;

an innersole located within the opening and adjacent to an outsole, the innersole comprising a plurality of holes for aiding in the removal of water from the shoe;

the outsole comprising a wicking textile on its upper surface and at least one drain hole, the at least one drain hole sloping upwardly from an outer surface of the outsole toward the wicking textile, wherein the wicking textile and the at least one drain hole aid in the removal of water from the shoe; and wherein at least one of the plurality of holes in the innersole is located over the wicking textile of the outsole and is connected to at least one drain hole of the outsole.

* * * * *